US009335111B2

(12) United States Patent
Miller, III

(10) Patent No.: US 9,335,111 B2
(45) Date of Patent: May 10, 2016

(54) ANTI-BOUNCE LIGHTWEIGHT HAMMER FOR FIREARM

(71) Applicant: Spike's Tactical, LLC, Apopka, FL (US)

(72) Inventor: Thomas James Miller, III, Lehigh Acres, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 14/719,934

(22) Filed: May 22, 2015

(65) Prior Publication Data

US 2016/0054085 A1 Feb. 25, 2016

Related U.S. Application Data

(60) Provisional application No. 62/041,343, filed on Aug. 25, 2014.

(51) Int. Cl.
*F41A 19/14* (2006.01)

(52) U.S. Cl.
CPC ..... *F41A 19/14* (2013.01)

(58) Field of Classification Search
CPC ..... F41A 19/14
USPC ..... 42/69.01–69.03, 65
See application file for complete search history.

(56) References Cited

U.S. PATENT DOCUMENTS

| | | | | |
|---|---|---|---|---|
| 935,237 | A * | 9/1909 | Savage | F41A 19/45 42/21 |
| 2,495,460 | A | 1/1950 | Koucky | |
| 3,683,537 | A * | 8/1972 | Silva | F41A 19/16 42/69.01 |
| 5,335,437 | A * | 8/1994 | Andersen | F41A 17/74 42/69.01 |
| 5,827,992 | A | 10/1998 | Harris et al. | |
| 8,001,881 | B2 | 8/2011 | Sy | |
| 2012/0180648 | A1 | 7/2012 | Sullivan et al. | |

* cited by examiner

*Primary Examiner* — Reginald Tillman, Jr.
(74) *Attorney, Agent, or Firm* — Wood Herron & Evans LLP

(57) ABSTRACT

Disclosed is an anti-bounce firearm hammer including a hammer member mountable in a firearm for pivotal movement about an axis. The hammer member includes a head portion with a strike face radially spaced from the pivot axis. A mass is attached to and movable with the hammer member in a direction substantially toward and away from the strike face. The mass has freedom of movement such that the mass will continue to move a limited distance independent of the hammer member after pivotal movement of the hammer member has stopped.

11 Claims, 2 Drawing Sheets

ANTI-BOUNCE LIGHTWEIGHT HAMMER FOR FIREARM

RELATED APPLICATION

This application claims priority to and the benefit of U.S. Provisional Patent Application No. 62/041,343 filed Aug. 25, 2014.

TECHNICAL FIELD

The present invention relates to the fire control mechanism for a firearm. More specifically, it relates to a lightweight pivoting hammer carrying an independently movable mass to reduce bounce or recoil on impact with a firing pin.

BACKGROUND

In a fire control mechanism, pulling a trigger breaks the engagement of a sear with a hammer, which is then pivoted by spring force into contact with a firing pin. The inertia of the moving hammer provides an impact force to the firing pin to detonate an ammunition primer.

In an effort to reduce the overall weight of a firearm, material may be removed from virtually any part, or parts may be made from lower density materials. If the mass of the hammer is reduced too much, it will lack sufficient momentum or inertia to strike the firing pin with enough force or may rebound from the firing pin causing "hammer bounce." If, in an effort to overcome the lack of hammer mass by increasing its velocity, the spring force is increased, other problems may be created by the significantly increased amount of force required to cock the hammer.

SUMMARY OF THE INVENTION

The present invention addresses these issues by providing a light weight hammer with a mass that is independently movable to a limited extent relative to the arcuate motion of the hammer. As a result, much like in a "dead blow" hammer, a portion of its mass continues moving after the initial impact, delivering its inertial force in a manner that counteracts rebound from the initial impact.

The invention provides an anti-bounce firearm hammer comprising a hammer member and a moveable mass attached thereto. The hammer member is mountable in a firearm for pivotal movement about an axis and includes a head portion with a strike face radially spaced from the pivot axis. A mass is attached to and movable with the hammer member in a direction substantially toward and away from the strike face. The mass has freedom of movement such that the mass will continue to move a limited distance independent of the hammer member after pivotal movement of the hammer member has stopped.

The mass may be located within the head portion. There may be a cavity in the head portion in which the mass is located, the cavity having an opening oriented substantially opposite the strike face, which may include a closure member for the cavity. The cavity may be an elongated bore situated substantially tangential to the pivot axis or may be an elongated arcuate bore situated substantially concentric with the pivot axis.

The mass may be made of a solid piece of material and may be made of material more dense than material from which hammer member is made. In one embodiment, the mass is comprised of tungsten.

Other aspects, benefits, and features of the present invention may be apparent to a person of skill in this art by reference to the following specification, drawing figures, and claims, all of which are part of the disclosure of the invention.

BRIEF DESCRIPTION OF THE DRAWING

Like reference numerals are used to indicate like parts throughout the various figures of the drawing, wherein.

DETAILED DESCRIPTION OF THE INVENTION

Figure 1:
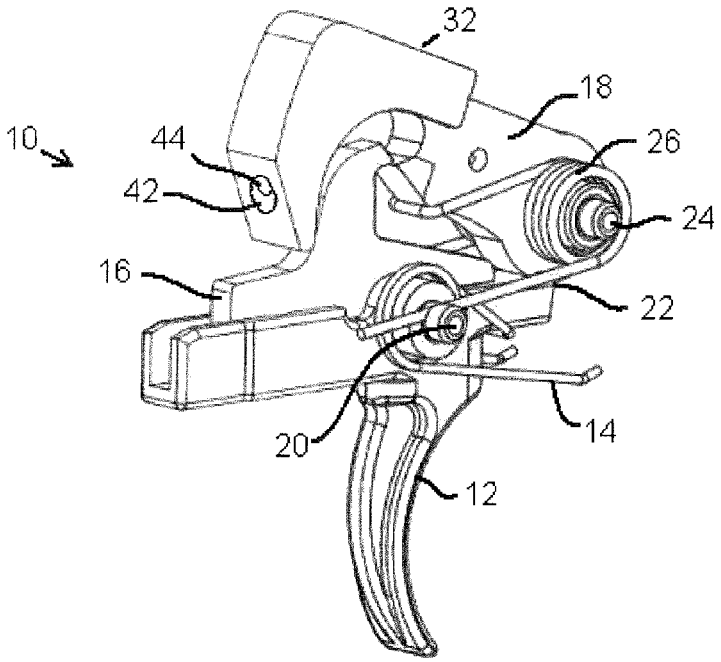
FIG. 1 is an isometric view of the fire control components in a typical AR15-style firearm.

Referring now to various figures of the drawing, and first to FIG. 1, therein as shown at 10 a typical fire control group (or mechanism) for a firearm. Typical components include a trigger 12, a trigger spring 14, a disconnector 16, and a hammer 18. The trigger 12 and disconnector 16 are pivotally mounted on a trigger pin 20, supporting them for limited pivotal movement relative to the receiver (not shown in FIG. 1). The trigger 12 includes or is directly connected to a sear 22. The trigger 12 is a biased toward a set position by a trigger spring 14. The hammer 18 is pivotally mounted on a hammer pin 24, which is also supported by the receiver (not shown in FIG. 1). The hammer 18 is biased toward a "dropped" position by a hammer spring 26. The fire control group 10 illustrated herein is that of a typical AR15-style firearm. These same components, in various forms, are found in any firearm mechanism. The present invention is not limited to the illustrated embodiment and may be used in most any firearm having a pivoting hammer, whether single-shot, semi-automatic, or fully automatic.

Figure 2:
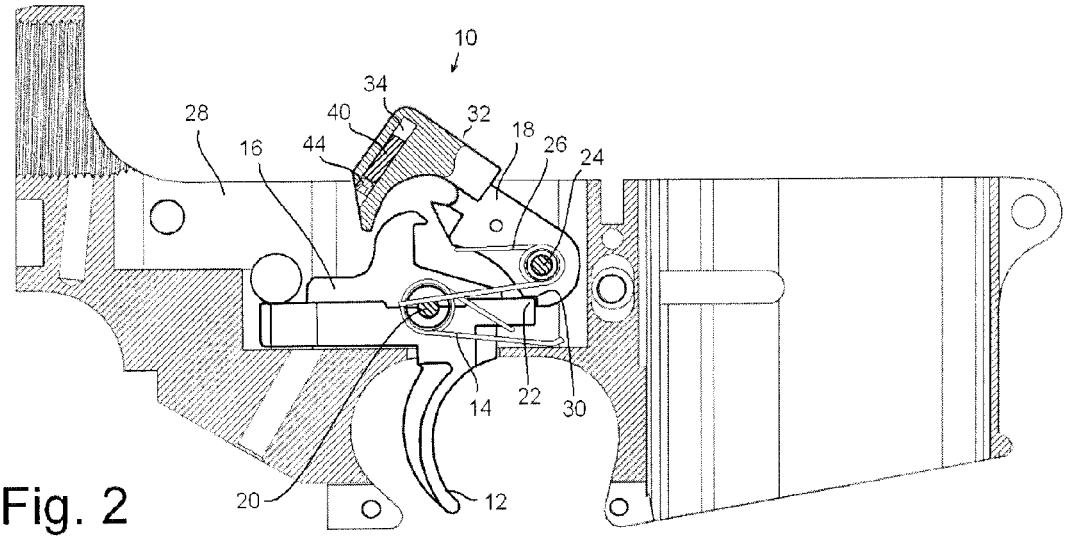
FIG. 2 is a longitudinal sectional view of the lower receiver of a typical AR15-style firearm showing the fire control components with the hammer in a cocked or set position and partially cut-away to illustrate the hammer's internal structure.

Referring now also to FIG. 2, therein, the fire control group 10 is shown mounted in an otherwise "stripped" AR15-type lower receiver 28. In the cocked or set position (FIGS. 1 and 2), the sear 22 engages a notch 30 on the hammer 18 against the force of the hammer spring 26.

According to one embodiment of the invention, within a head portion 32 of the hammer 18, a cavity 34 is provided which may extend in a direction substantially tangential to or along an arc of travel (arrow 36) along which the hammer 18 pivots. According to one embodiment, the cavity 34 may be formed, such as drilling, from a rear side of the head portion 32 toward, but short of, the striking face 38 of the head portion 32. A moving mass 40 is provided that is sized and shaped to fit within and freely slide along the length of the cavity 34. The moving mass 40 is typically of a relatively higher density material and can be a solid piece of material; a flowable dry material, such as metallic pellets or powder; or could be a high-density liquid, such as mercury. According to one embodiment, the moving mass 40 may be formed from a tungsten rod approximately ⅛ inch in diameter and 7/16 inch long. The open rear end 42 of the cavity 34 may be sealed in order to capture the moving mass 40 within the cavity 34 by any suitable means. According to one embodiment, a set screw 44 may be threaded into the open end 42 of the cavity 34 and then sealed in position by means of an adhesive or by staking.

Figure 4:
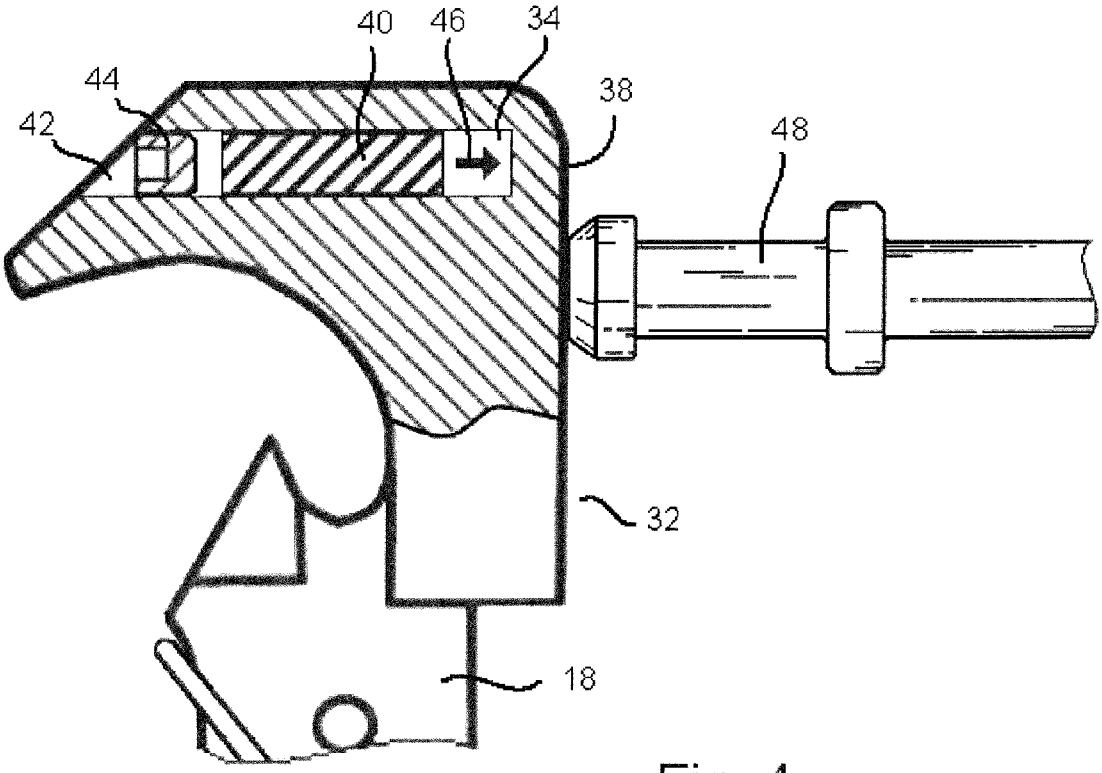
FIG. 4 is an enlarged fragmentary and partially cut-away view of the hammer upon initial contact with a firing pin.
Figure 3:
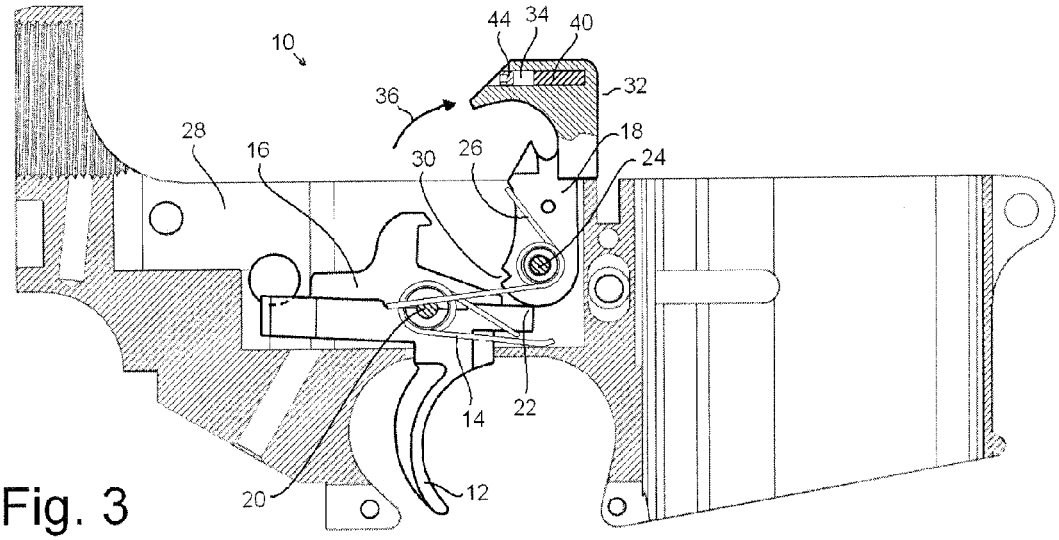
FIG. 3 is a view like FIG. 2, but with the hammer illustrated in the dropped position.

When the hammer 18 is in the set or cocked position (FIGS. 1 and 2) and as the hammer begins a forward movement, a movable mass 40 will remain at or toward the rear of the cavity 34. Referring now in particular to FIGS. 3 and 4, when the hammer 18 reaches its forward or dropped position, the movable mass 40 will continue traveling forward (arrow 46 in FIG. 4) until it reaches the forward-most end of the cavity 34 (FIG. 3), transferring its momentum force to the firing pin 48 as it is struck by the hammer face 38. Typically, the mass 40 will be made of a material more dense than that of the hammer 18, such that the loss of weight resulting from formation of the cavity 34 is largely compensated or exceeded by the weight of the mass 40.

In this manner, rebound or bounce of the hammer 18 against the firing pin 46 is offset by the slightly delayed transfer of momentum from the movable mass 40. Accordingly, the overall mass of the hammer 18 and/or the tension of the hammer spring 26 may be reduced without the negative effect resulting from rebound or "bounce" that might otherwise occur. This reduction in weight may be accomplished by making a portion or all of the hammer 18 from a lower density material than usual or by removing nonessential material (i.e., "skeletalizing") from the hammer 18. Alternately, the hammer 18 may be made by metal injection molding (MIM) of powdered steel or aluminum, with the mass 40 being made of a higher density material.

The specific weight of the movable mass 40 as well as the amount travel it is permitted may be varied in order to meet specific needs and designs. Likewise the radial distance at which the mass 40 is located relative to the hammer's axis of rotation (on hammer pin 24) may be varied to affect the performance of the invention. While there are certain apparent advantages of having the movable mass 40 contained within a sealed cavity 34, as illustrated, the same effect can be achieved with a moveable mass that is exposed or located on the exterior of the hammer 18 and guided by any suitable means along a limited path of travel.

While an exemplary embodiment of the present invention has been described in detail, it should be apparent that modifications and variations thereto are possible, all of which fall within the true spirit and scope of the invention disclosed herein. Therefore, the foregoing is considered as illustrative only of the principles of the invention and, since modifications and changes will be apparent to those skilled in the art, it is not intended to limit the invention to the exact construction and operation shown and described. Accordingly, all suitable modifications and equivalent may be resorted, falling within the scope of the invention.

What is claimed is:

1. An anti-bounce firearm hammer, comprising, a hammer member mountable in a firearm for pivotal movement about an axis, the hammer member including a head portion with a strike face radially spaced from the pivot axis; and a mass attached to and movable with the hammer member in a direction substantially toward and away from the strike face, the mass having freedom of movement such that momentum causes the mass continue moving a limited distance independent of the hammer member after pivotal movement of the hammer member has stopped.

2. The firearm hammer of claim 1, wherein the mass is located within the head portion.

3. The firearm hammer of claim 1, further comprising a cavity in the head portion in which the mass is located, the cavity having an opening oriented substantially opposite the strike face.

4. The firearm hammer of claim 3, further comprising a closure member for the cavity.

5. The firearm hammer of claim 1, further comprising a cavity in the head portion in which the mass is located, the cavity being an elongated bore situated substantially tangential to the pivot axis.

6. The firearm hammer of claim 1, further comprising a cavity in the head portion in which the mass is located, the cavity being an elongated arcuate bore situated substantially concentric with the pivot axis.

7. The firearm hammer of claim 1, wherein the mass comprises a solid piece of material.

8. The firearm hammer of claim 1, wherein the mass is comprised of material more dense than material from which hammer member is made.

9. The firearm hammer of claim 1, wherein the mass is comprised of material more dense than material from which the head portion of hammer member is made.

10. The firearm hammer of claim 1, wherein the mass is comprised of tungsten.

11. An anti-bounce firearm hammer, comprising:

a hammer member configured to be mounted for pivotal movement between a cocked position and a dropped position; and a movable mass attached to the hammer for limited movement along a path that freely allows independent further forward inertial movement of the mass once the hammer member has reached the dropped position.

* * * * *